US006792729B2

(12) United States Patent
Béliveau

(10) Patent No.: US 6,792,729 B2
(45) Date of Patent: Sep. 21, 2004

(54) STACKABLE CONSTRUCTION PANEL SYSTEM

(75) Inventor: Jean-Louis Béliveau, Magog (CA)

(73) Assignee: Polyform A.G.P. Inc., Quebec (CA)

( * ) Notice: Subject to any disclaimer, the term of this patent is extended or adjusted under 35 U.S.C. 154(b) by 320 days.

(21) Appl. No.: 09/968,869

(22) Filed: Oct. 2, 2001

(65) Prior Publication Data

US 2002/0162294 A1 Nov. 7, 2002

(51) Int. Cl.[7] ..... E04B 2/00

(52) U.S. Cl. ..... 52/426; 52/429; 52/441; 52/421; 52/561; 52/562; 52/712; 52/715; 52/422; 52/425; 52/427; 52/279

(58) Field of Search ..... 52/426, 429, 441, 52/421, 561, 562, 712, 715, 422, 425, 427, 279

(56) References Cited

U.S. PATENT DOCUMENTS

| | | | | | |
|---|---|---|---|---|---|
| 4,091,585 | A | * | 5/1978 | Rudichuk | 52/274 |
| 5,459,971 | A | * | 10/1995 | Sparkman | 52/426 |
| 6,230,462 | B1 | * | 5/2001 | Beliveau | 52/426 |
| 6,338,229 | B1 | * | 1/2002 | Botzen | 52/371 |
| 6,401,419 | B1 | * | 6/2002 | Beliveau | 52/592.6 |

FOREIGN PATENT DOCUMENTS

| | | |
|---|---|---|
| CA | 11454584 | 5/1983 |
| DE | 4244289 | 6/1994 |
| EP | 275938 | 1/1988 |
| EP | 0 995 853 | 4/2000 |
| FR | 522307 | 7/1921 |

OTHER PUBLICATIONS

European Patent Office Invitation to Pay Additional Fee and Communication Relating to the Results of the Partial International Search dated Aug. 9, 2002.
PCT international Search Report mailed on Oct. 24, 2002.

* cited by examiner

*Primary Examiner*—Carl D. Friedman
*Assistant Examiner*—Steve M Varner
(74) *Attorney, Agent, or Firm*—St. Onge Steward Johnston & Reens

(57) ABSTRACT

Improvements in a stackable construction panel system are disclosed. The system includes stackable wall forms for receiving a flowable material, each form having a pair of foam panels tied together in a spaced and parallel relationship by connectors. In a first improvement, the connectors have head pieces with transversal terminal surfaces facilitating the stacking and handling of the wall forms on construction sites. In a second improvement, an end panel assembly is provided for mounting an end panel used as a wall stud for the construction of a window or door frame. The end panel assembly has first and second engaging members, each removably engageable with side end portions of the pair of foam panels. The end panel itself is mountable therebetween. In accordance with a third improvement, a corner connector is provided for reinforcing corner wall forms.

19 Claims, 8 Drawing Sheets

STACKABLE CONSTRUCTION PANEL SYSTEM

FIELD OF THE INVENTION

The present invention relates generally to stackable wall forms of the type having pairs of opposed panels for receiving flowable materials such as concrete. More particularly, it relates to improvements in such wall forms.

BACKGROUND OF THE INVENTION

A number of different systems and methods currently exist for making insulating forms for casting a concrete wall. Often, these systems include pairs of opposed foam panels generally made of rigid foam like polystyrene, which define concrete-receiving cavities therebetween. Those pairs of foam panels are placed one above the other so as to form the wall form assembly. Once the concrete is solidified, the assembled wall forms remain in place to insulate the wall. Before the pouring of concrete, the opposed foam panels are typically maintained in spaced and parallel relationship by connectors each having a pair of parallel lateral attachment flanges embedded in the respective foam panels, and a connecting web interconnecting the flanges.

The stacking of such panels is performed on the construction site. It is desirable in this field to provide wall forms that allow, on one hand, an easy and very rapid stacking without loosing time and, on the other hand, allow construction of a stable and solid stack that is unlikely to accidentally disassemble prior to the pouring of concrete. As can be easily understood, as soon as the concrete is poured, the chances that the stack collapses or disassembles, are greatly reduced.

By way of example, wall forms and construction foam panels of the type discussed above are shown in published Canadian patent applications nos. 2,292,865 and 2,312,158, both in the name of the present assignee. Other examples of insulating construction panel are shown in U.S. Pat. Nos. 3,895,469; 4,229,920; 4,884,382; 4,885,888, 4,894,969; and 5,428,933.

SUMMARY OF THE INVENTION

An object of the present invention is to propose an improved stackable foam panel that allows the easy construction of a stable and solid stack.

In accordance with a first aspect of the present invention, there is provided a connector for tying together opposed foam panels in spaced and parallel relationship along a longitudinal direction, to make a form for receiving a flowable material. The connector includes a pair of elongated anchor members, each being devised to be embedded longitudinally inside a corresponding one of the foam panels. Each of the anchor members has two opposed extremities. A head piece projects from each of these extremities along the longitudinal direction. The head pieces each have a terminal surface extending transversally.

The connector also has a connecting member for connecting longitudinally the anchor members of the pair together.

This aspect of the present invention further concerns a wall form for receiving a flowable material. The wall form includes:

- a pair of foam panels, each having opposed top and bottom wall surfaces; and a connector for tying together said foam panels in spaced and parallel relationship along a longitudinal direction. As explained above, this connector includes a pair of elongated anchor members each embedded longitudinally inside a corresponding one of the foam panels, each of these anchor members having two opposed extremities and a head piece projecting from each of these extremities along the longitudinal direction. The head pieces each have a terminal surface extending transversally, and along a portion of a corresponding one of the top and bottom wall surfaces of the corresponding foam panel. The connector further includes a connecting member for connecting longitudinally the anchor members of the pair together. Each of the top and bottom wall surfaces of each of the foam panels is provided with alternating projections and recesses, the head pieces each being embedded into one of these projections.

In accordance with a second aspect of the present invention, there is provided a mounting device for mounting an end panel to a wall form for receiving a flowable material. The wall form has a pair of opposed foam panels in spaced and parallel relationship along a longitudinal direction, the pair of foam panels having aligned side end portions. The mounting device includes:

- first and second engaging members for removably engaging the respective side end portions of the pair of foam panels; and
- mounting means for longitudinally mounting the end panel between the first and second engaging members, when the same are engaged with the end portions of the pair of foam panels.

There is further provided by the present invention as part of the second aspect thereof, an end panel assembly for a wall form for receiving a flowable material. The wall form has a pair of opposed foam panels in spaced and parallel relationship along a longitudinal direction, the pair of foam panels having aligned side end portions. The end panel assembly includes a mounting device as described above, and an end panel mountable between the engaging members of this mounting device.

Also provided is a wall form for receiving a flowable material, this wall form including a pair of opposed foam panels in spaced and parallel relationship along a longitudinal direction, the pair of foam panels having aligned side end portions. Each of the foam panels is provided with a longitudinal ridge extending therein along an inward surface thereof, with the inward surface facing the opposed foam panel. The wall form further includes an end panel, and a mounting device. The mounting device has first and second engaging members removably engaging the respective side end portions of the pair of foam panels. Mounting means are further provided for longitudinally mounting the end panel between the first and second engaging members.

Finally, in accordance with a third aspect of the present invention, there is provided an improvement in a wall form for receiving a flowable material, this wall form having a corner formed by longitudinally contiguous foam panel sections angled with respect to each other. The improvement provides that the wall form includes a reinforcing connector for reinforcing its corner. The connector has a pair of elongated anchor members, each being embedded longitudinally inside a corresponding one of the foam panel sections. A connecting member extends inside of the wall form and spans the corner from the anchor member of one of the pair of foam panel members to the anchor member of the other of the pair of foam panel members. The connecting member is removably connected to the pair of anchor members.

Other features and objects of the present invention will become more apparent from the description that follows of a preferred embodiment, having reference to the appended drawings and given as examples only as to how the invention may be put into practice.

DESCRIPTION OF PREFERRED EMBODIMENTS OF THE INVENTION

The present invention is directed to improvements in a stackable construction system, using wall forms made of parallel foam panels for receiving a flowable material such as concrete. Below is a description of preferred embodiments of such a wall form. It is understood however that the description below is given by way of example, and that the present invention may be applied to wall forms having different characteristics.

Description of a Preferred Embodiment of a Wall Form

Figure 1:
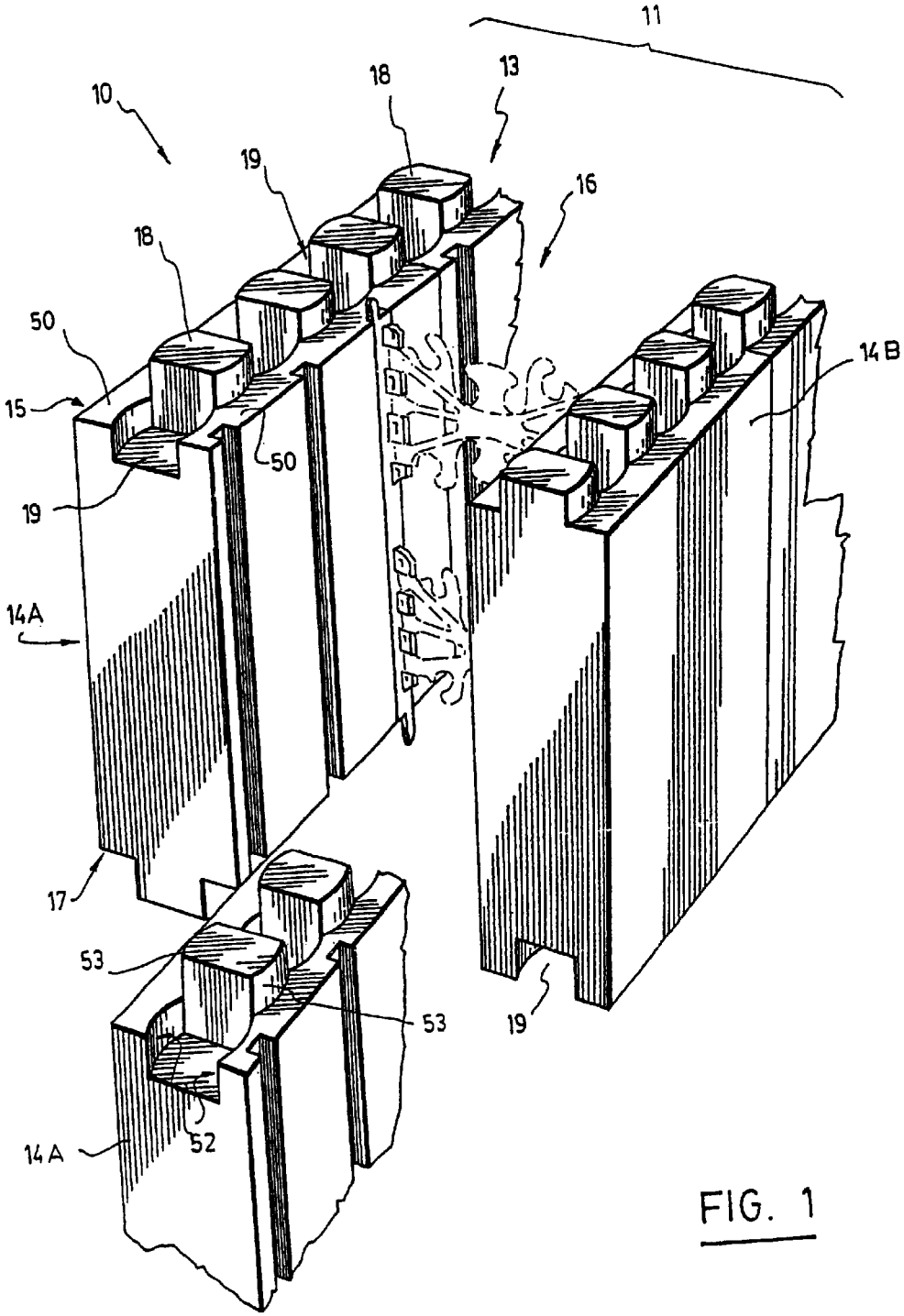
FIG. 1 is a perspective fragmentary view of a form wall assembly according to a preferred embodiment of the present invention.

Referring to FIG. 1, there is shown a wall form assembly (10), which is suitable to make a form for receiving flowable materiel such as concrete or the like. This assembly (10) includes a plurality of stacked insulating horizontal rows of wall forms (11), each made of coplanar and substantially rectangular foamed plastic panels (14A, 14B). The panels (14A, 14B) of neighbouring wall forms (11) abut one another along their horizontal and vertical sides.

Each wall form (10) more particularly includes a first foam panel (14A) and an opposed second foam panel (14B), disposed in a spaced and parallel relationship, and tied together by a plurality of connectors (16). The foam panels (14A, 14B) are movable between an extended position, as shown in FIG. 1, where the foam panels (14A, 14B) are spaced-apart to make the wall form and a collapsed position, not illustrated, where the foam panels (14A, 14B) are brought close to each other, mainly for shipping purposes.

In use, once a wall form assembly for receiving flowable material is mounted using a plurality of stacked horizontal rows of wall forms, the empty cavity existing between the panels (14A, 14B) is filled with concrete or with cement based grout. After hardening of the filling material, a composite wall is obtained with the isolating panels firmly attached through the connectors to the concrete inside-wall.

The foam panels (14A, 14B) each have a top wall surface (15) opposite a bottom wall surface (17), each of which being preferably provided with a median row (13) of alternating projections (18) and recesses (19) having a similar complementary shape. This median row (13) is disposed between two coplanar edge surfaces (50) bordering the edges of the panels (14A, 14B). These coplanar edge surfaces (50) preferably have a width sufficiently large so as to offer an increased stability between interlocked panels (14A, 14B).

Each projection (18) or recess (19) of the top wall surface (15) of one panel (14A) is opposed respectively to a recess (19) or a projection (18) of the bottom wall surface (17) of the same panel (14A), and is facing respectively a recess (19) and a projection (18) of the top side (15) of the other panel (14B), when the pair of panels (14A and 14B) are in the extended position as in FIG. 1. It will be understood that in this manner, the pair of panels (14A, 14B) may advantageously be interconnected with a like pair of panels with either of its opposed wall surfaces (15, 17) acting as the top or bottom wall surface.

Mainly because of the manufacturing process, in a preferred embodiment, the projections (18) and the recesses (19) are generally rectangular. However, projections and recesses of other shapes such as circular, oblong, square etc. could also be used. In addition, in order to prevent the deterioration of the projection (18), the present invention prefers using projections (18) with rounded-corners. Nevertheless, projections (18) with square-corners or other forms, would still be efficient. Preferably, each of the projections (18) and the recesses (19) has two opposite substantially convex lateral surfaces (52, 53), which facilitate the insertion of the projections (18) in the recesses (19).

Figure 2:
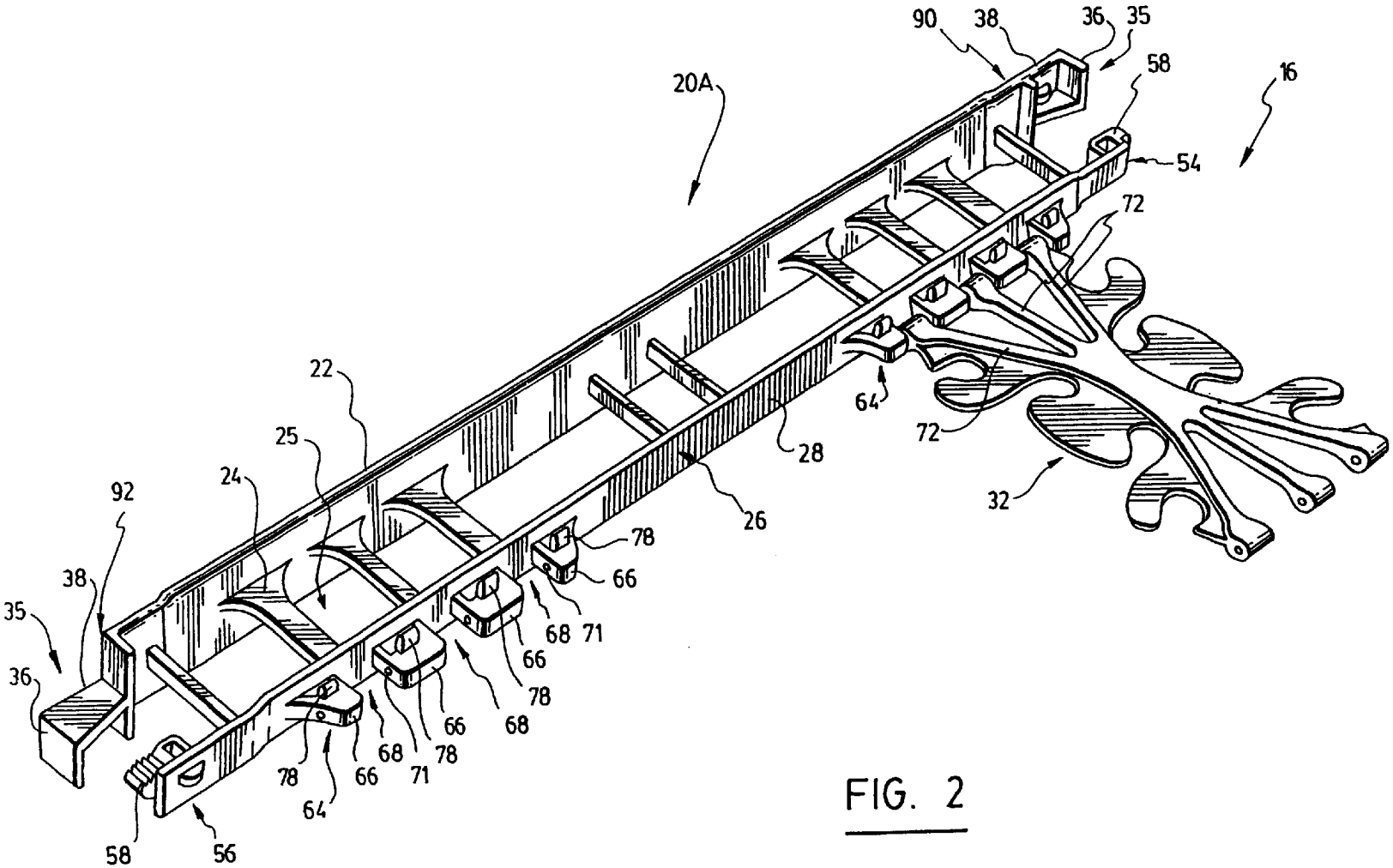
FIG. 2 is a perspective view of a connector according to a preferred embodiment of the invention, shown without its right anchor member and a portion of the web member.
Figure 3:
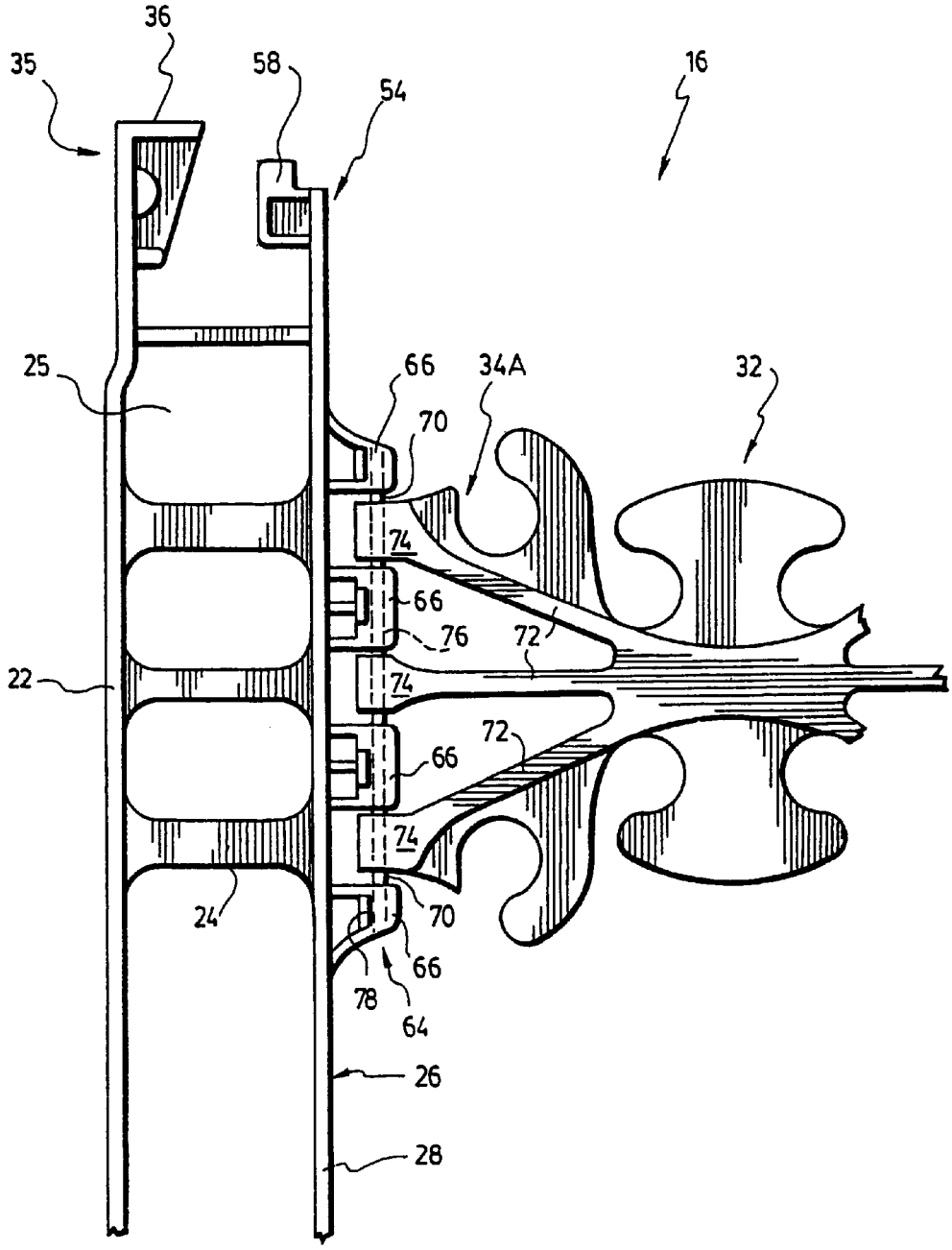
FIG. 3 is a side view in partial transparency of a portion of the connector of FIG. 2.
Figure 4:
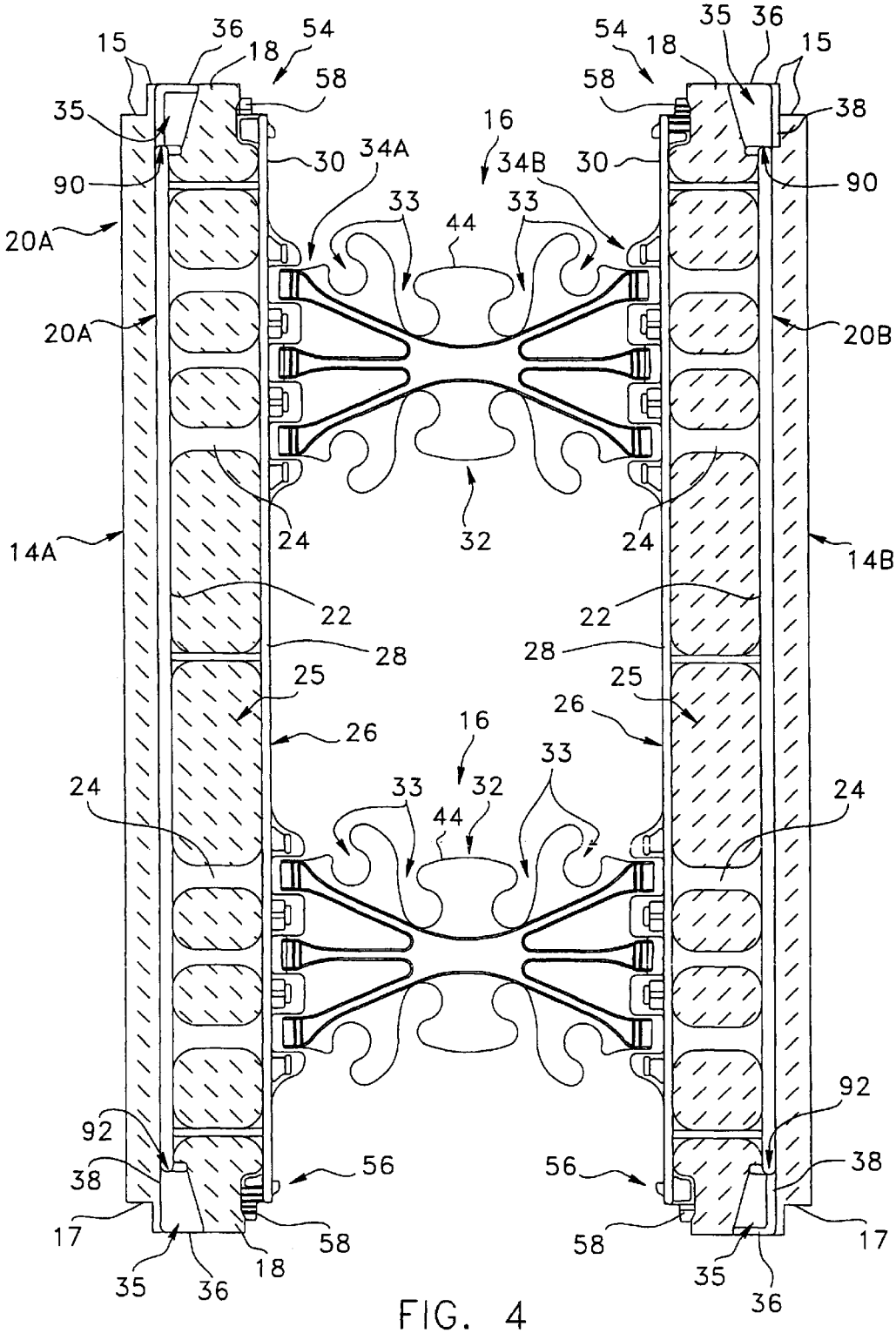
FIG. 4 is a cross-sectional side elevation view of the form wall assembly of FIG. 1.

Referring to FIGS. 2, 3 and 4, there is shown in more detail, parts of a connector (16) in accordance with a preferred embodiment of the present invention. The connector (16), includes a pair of anchor members (20A, 20B), respectively embedded in the first and second foam panels (14A, 14B). Each anchor member (20A, 20B) has an elongated flange plate (22) extending longitudinally and deep inside the corresponding foam panel (14A or 14B) and an elongated link element (24) connected longitudinally to the flange plate (22). The link element has a projecting end (26) coming out of the foam panel (14A, 14B). Preferably, the projecting end (26) of each anchor member (20A, 20B) comprises a stabilising plate (28) parallel to the flange plate (22) and extending flush with the inner surface (30) of the corresponding foam panel (14A or 14B) when embedded therein, as shown in FIG. 4.

The stabilising plate (28) of each anchor member (20A, 20B) preferably has an upper end (54) and a lower end (56) both comprising a fastener (58) to link the anchor member (20A or 20B) to a mating anchor member (20A or 20B) of an adjacent wall form (11). More preferably, the fastener (58) is a grapnel-type fastener moulded on the stabilising plate (28) with an extremity projecting from the corresponding end of the stabilising plate (28). The fastener (58) of the upper end (54) of a given stabilising plate (28) is preferably in mirror symmetry with the fastener (58) of the lower end (56) of that stabilising plate (28), as best shown in FIGS. 2 and 4, and has a side provided with pointed teeth adapted to link with the pointed teeth of a mating anchor member (20A, 20B). Advantageously, this embodiment allows the connector (16) to be used with either end being the top or bottom end, greatly facilitating the handling of the wall form on construction sites.

In order to lighten the foam panel assembly, the link element (24) preferably comprises a plurality of holes (25) therealong. However, the link element (24) may also be plane solid.

It should be noted that by saying that the anchor members (20A, 20B) are embedded in the foam panels (14A, 14B), a person skilled in the art will understand that in the making of the foam panels (14A, 14B) in the manufacturing plant, the plastic foam material forming the panels (14A, 14B) is preferably injected to surround the anchor members (20A, 20B), thereby strengthening the joint between the panels (14A, 14B) and the anchor members (20A, 20B), which thus act as an anchor forming part of the foam panels (14A, 14B). More specifically, the plastic foam material, which is preferably polystyrene or any other material known to a person skilled in the field of plastic foam, is injected to surround the anchor members (20A, 20B).

The connector (16) further includes a web-shaped connecting member (32) extending between the foam panels (14A, 14B). This connecting member (32), which is preferably made of a relatively flexible plastic material, has a central portion (44) shaped to receive and hold metal rods used to reinforce the concrete. The connecting member (32) further has a first longitudinal side end (34A) hingedly connected to the projecting end (26) of the first anchor member (20A), and a second longitudinal side end (34B) opposed to the first longitudinal side end (34A). The second longitudinal side end (34B) is hingedly connected to the projecting end (26) of the second anchor member (20B). The foam panels (14A, 14B) are therefore movable between an extended position, as shown in FIG. 1, where the foam panels (14A, 14B) are spaced-apart to make the wall form (11), and a collapsed position, not illustrated, where the foam panels (14A, 14B) are brought close to each other, mainly for shipping purposes.

The connecting member (32) is preferably symmetrical in shape so as to receive and hold metal rods used to reinforce the concrete in reversible positions of the wall form (11). Hence, the wall form (11) can be turned upside down and still be used to receive and hold metal rods in top grooves (33) of the connecting member (32).

A plurality of connecting elements (64) are preferably disposed on the stabilising plate (28) of the projecting end (26) of each anchor member (20A, 20B), in order to hingedly connect the connecting member (32) to the anchor members (20A, 20B). Each of these connecting elements (64) is shaped to form two aligned ridges (66) projecting from the stabilising plate (28), and the space between them defines a longitudinal sleeve (68). A joining pin (70) can be mounted in the sleeve (68). Preferably, pin receiving holes (71) are provided in the ridges (66) for this purpose, each hole (71) facing inwardly of the sleeve (68). The connecting member (32) is preferably made by plastic molding and the joining pin (70) is thus permanently mounted in the ridges (66).

To cooperate with the connecting elements (64), each longitudinal side end (34A, 34B) of the connecting member (32) defines a corresponding number of arms (72). For example, three arms (72) can be used in a symmetrical connecting member (32). Each arm (72) has an extremity (74) connected to a corresponding joining pin (70) so as to be rotatable around an axis defined by the joining pin (70). It can be easily seen that this purpose may be achieved by either mounting the extremity (74) of the arm (72) rotatably around the joining pin (70), or mounting the joining pin (70) itself rotatably in the pin receiving holes (71). Preferably, the extremity (74) of each arm (72) is provided with a bore (76) for receiving one of the pins (70).

As will be readily understood by a person skilled in the art, the connecting elements (64) may be formed directly by molding during manufacturing of the anchor members (20A, 20B). In the illustrated embodiment of FIGS. 2 and 3, a protrusion (78) is generated by the molding process on each side of the ridges (66).

It will be understood that although the connecting elements (64) are shaped to form aligned ridges (66), the present invention contemplates employing other types of connecting elements that would be apparent to a person skilled in the art, such as open slotted tube-like knuckles. In this alternative embodiment, the connecting member (32) may advantageously be removed from the corresponding anchor member (20A or 20B). Such an embodiment is for example illustrated in FIG. 6, with respect with a corner connector as will be explained below. in order to hingedly connect the connecting member (32) to the anchor members (20A or 20B), the connector (16) is provided with a plurality of aligned open slotted tube-like knuckles (360) positioned on the stabilising plate (28), each tube-like knuckle (360) forming an inner tube having a pair of longitudinal opposed edge portions defining a slot (365) in registry with the slots of the other knuckles (360). The connecting member (32) has a pair of longitudinal side end each defining an enlarged end portion (370) sized to be slidably insertable in said open tube-like knuckles and a strip portion (375) connecting the enlarged end portion (370) to a central portion of the connecting member (32).

Improvement to the Connector

Still referring to FIGS. 2, 3, and 4, and in accordance with a first aspect of the present invention, each anchor member (20A, 20B) has two opposed extremities (90, 92) from which projects a head piece (35) along the longitudinal direction. Preferably, the head pieces (35) are connected to the upper and lower ends (90, 92) of the flange plate (22) of the corresponding anchor member (20A or 20B). The head pieces (35) each have a terminal surface (36), extending transversally. Preferably, each head piece (35) has an L-shaped portion forming a transversal arm defining the terminal surface (36), and a longitudinal arm (38) connecting the transversal arm (36) to the extremity (90 or 92) of the anchor member (20A or 20B) from which the head piece (35) is projecting.

When the connector (16) is embedded into the foam panels (14A, 14B) to make the wall form (11), each head piece (35) is preferably aligned and embedded in a projection (18) of the panel, as best shown in FIG. 4, and covers half of the upper and lower ends (90, 92) of a flange plate (22), as best viewed in FIG. 2. The other half of the extremities of the flange plate (22) corresponds to a recess (19). Preferably, the terminal surface (36) of the head piece (35) extends flush with the corresponding top or bottom wall surface (15, 17) of the projection (18).

Preferably, the head piece (35) of the upper end (90) of a given member is in mirror symmetry with the head piece (35) of the lower end (92) of that flange plate (22), and with the head piece (35) provided on the upper end (90) of the flange plate (22) of the other anchor member. Therefore, a connector (16) can be flipped over or turned around in any direction and can still be used properly when it is positioned right in between a projection (18) and a recess (19).

The head piece (35) serves two main purposes. First, the head piece (35) helps supporting the weight of the entire form wall assembly (10) when concrete is poured into the form wall assembly (10). Indeed, tests have shown that without the head piece (35), the form wall assembly (10) has a tendency to sag in height after concrete is poured in, by as much as two inches.

Secondly, the head piece (35) facilitates the stacking of wall forms (11) one on top of the other. Indeed, without the head piece (35), it is difficult for a worker to push a first wall form (11) on top of a second wall form (11) to properly connect them. With the provision of the head pieces (35), a worker can hammer or push on the terminal surface (36) of the head piece (35) to more easily assemble the wall forms (11) together.

End Panel Assembly

Figure 5:
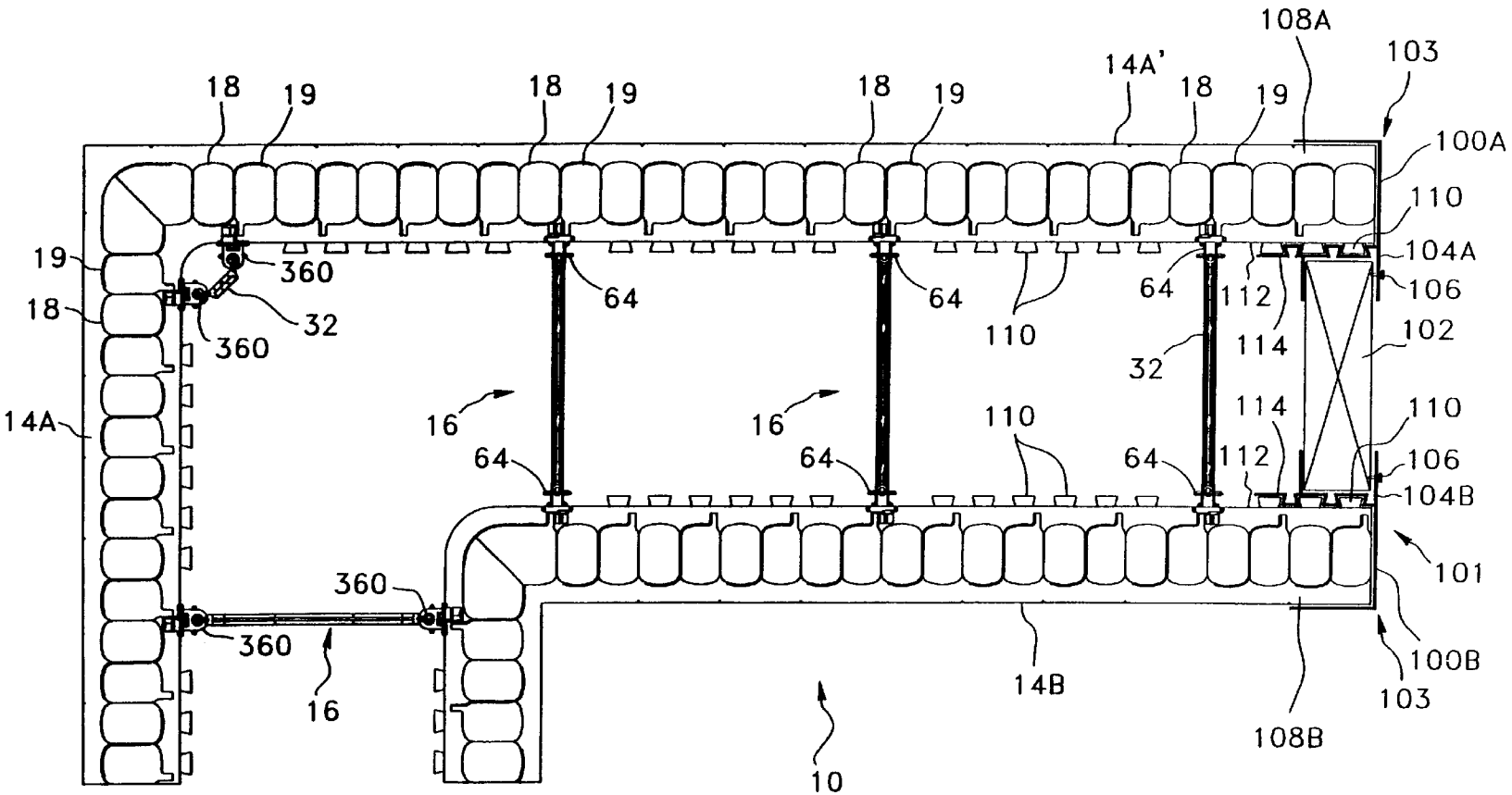
FIG. 5 is a top view of a 90 degree corner form wall assembly according to a preferred embodiment of the invention.
Figure 5A:
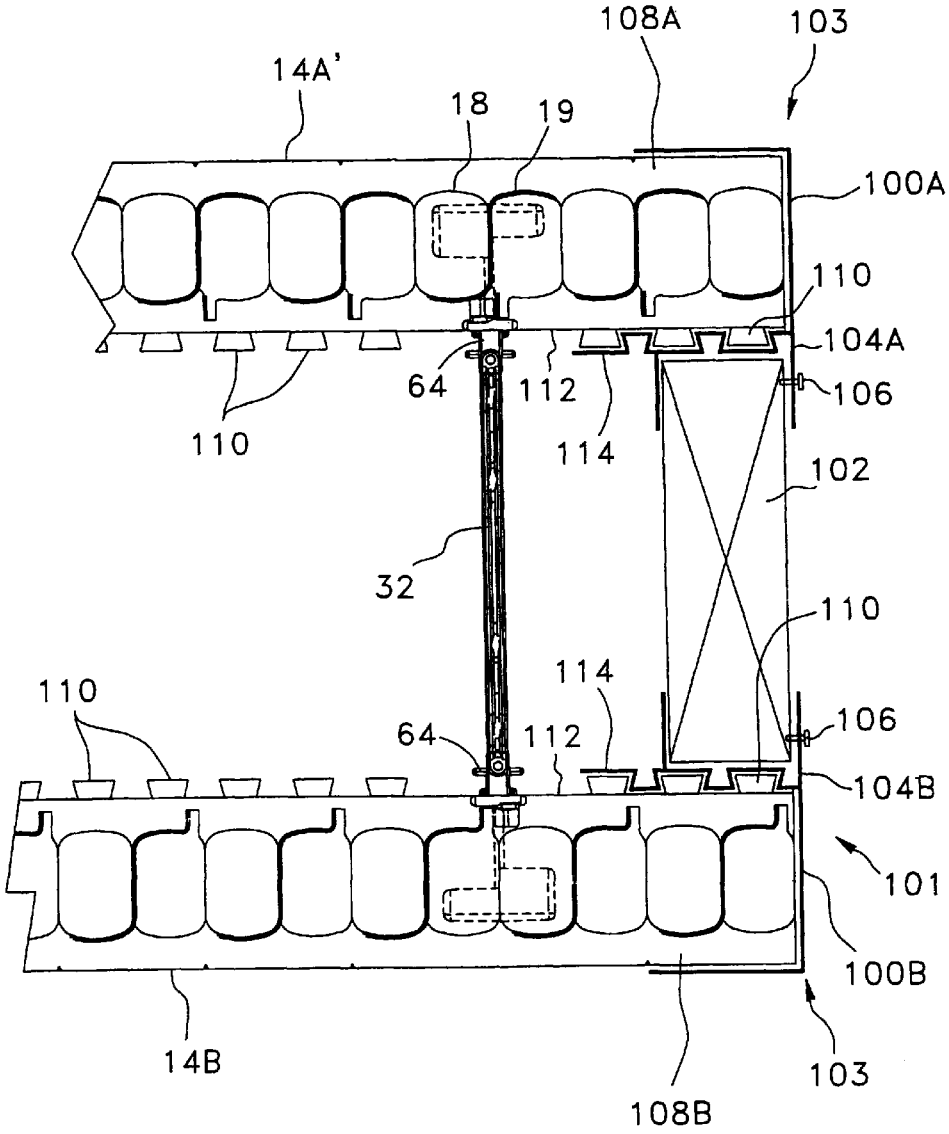
FIG. 5A is an enlarged view of the side end portion of the wall form of FIG. 5.

Referring now to FIG. 5, there is shown a second aspect of the present invention. An end panel assembly (101) is provided for mounting an end panel (102) on the side extremities of a wall form assembly (10). The end panel may for example be used solely for blocking the side extremities of the wall form assembly (10), and containing the concrete in the structure defined by the wall form when pouring. Advantageously, the end panel (102) is also used as a wall stud for the construction of, for example, a window, a door frame, etc.

The end panel assembly (101) includes the end panel (102) and a mounting device (103) for mounting the end panel (102) to a sidemost wall form (11). The end panel (102) is preferably made of wood, for example a set of wood pieces stacked one on top of the other, and extends through the entire height of the wall form assembly (10). The foam panels (14A, 14B) of the wall form (11) have aligned side end portions (108A, 108B), to which the mounting device (103) is affixed. This mounting device includes first and second engaging members (100A, 100B), which are removably engageable with the respective side end portions (108A, 108B) of the panels (14A, 14B). Preferably, the first and second engaging members (10A, 100B) each define a sleeve for enfolding the end portion (108A, 108B) of a corresponding foam panel (14A, 14B), and is made of a resilient material such as a plastic. Preferably, the engaging members (100A, 100B) are shaped to conform to the shape of the side end portions (108A, 108B) of the foam panels (14A, 14B), and are simply mounted thereon by resiliently hugging the foam panels. In the illustrated embodiment, each foam panel (14A or 14B) has longitudinal ridges (110) extending along its inward surface (112), that is, the surface facing the opposed foam panels (14B or 14A), and each engaging member is provided with corresponding channels (14) engageable with each ridge (110).

The mounting device (103) also includes mounting means for longitudinally mounting the end panel (102) between the first and second engaging members (100A, 100B), when they are themselves engaged with the end portions (108A, 108B) of the pair of foam panels. For example, the mounting means may be embodied by first and second supporting portions (104A, 104B), respectively projecting from the first and second engaging members, inwardly of the pair of foam panels (14A, 14B). As seen in FIG. 5, the two supporting portions (104A, 104B) may define a track for slidably receiving the end panel (102). Screws (106) or any other appropriate type of fasteners preferably fix the end panel (102) to the supporting portions (104A, 104B). The mounting means of the present invention are not however limited to the above-described embodiment. For example, instead of defining a track, the first and second projecting portions may simply define walls on which the end panel is solidly fastened. In another embodiment, instead of two supporting portions, a single connecting member joining the two engaging members together, may be provided, either defining a wall or a track.

Reinforced Corner

Figure 6:
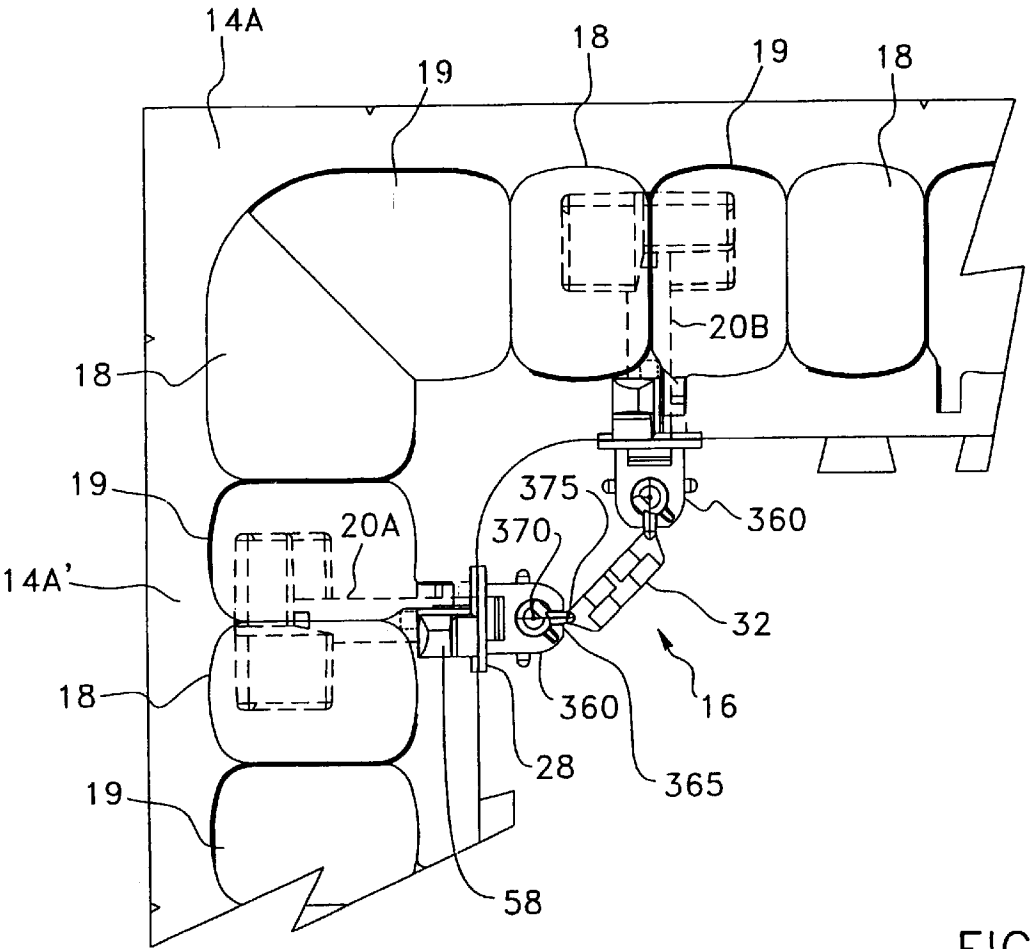
FIG. 6 is an enlarged top view of a portion of the corner form wall assembly shown in FIG. 5.
Figure 7:
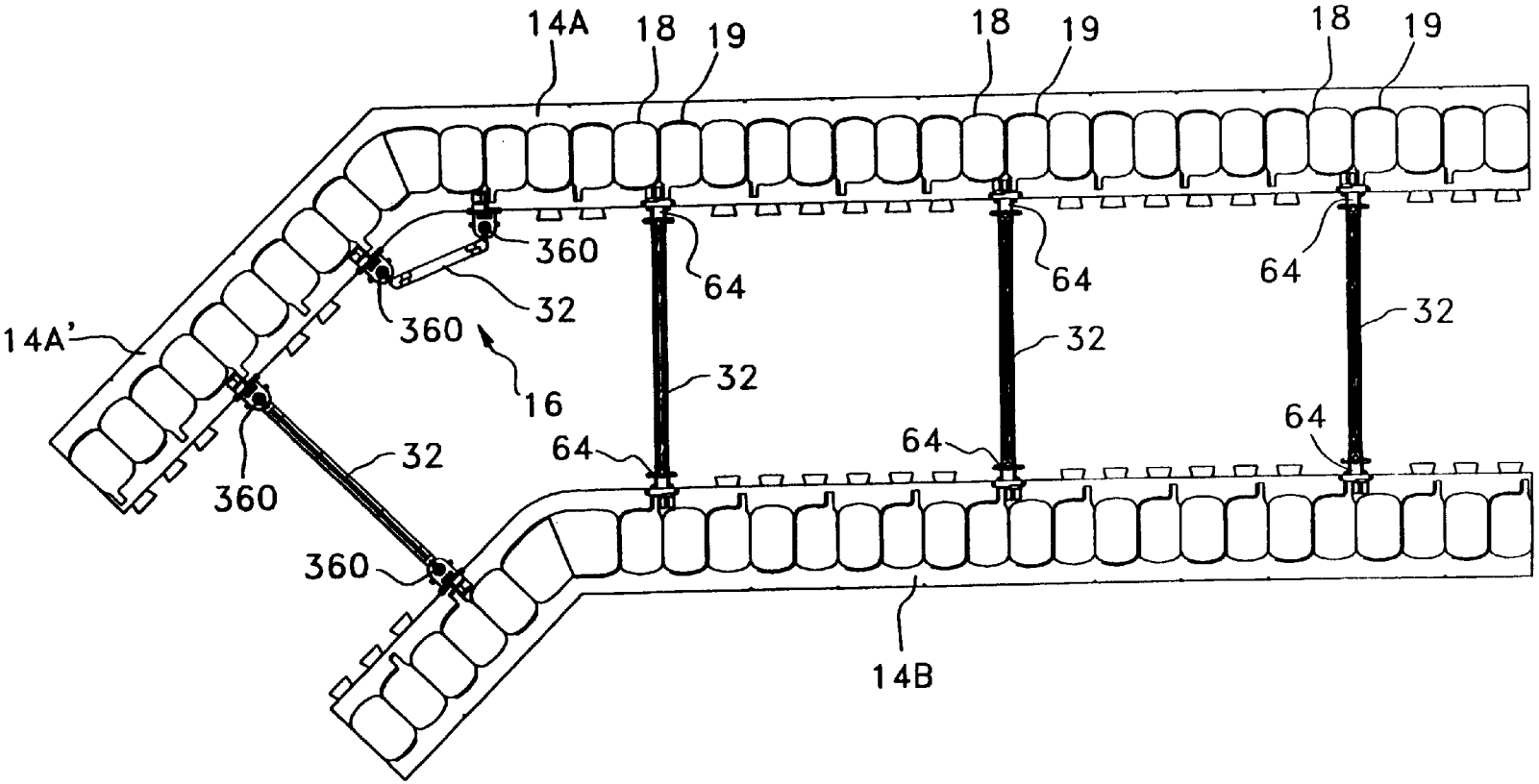
FIG. 7 is a top view of a 45 degree corner form wall assembly according to a preferred embodiment of the invention.

Referring now to FIGS. 5 to 7, there is shown a third aspect of the present invention involving wall forms used for corners. The corner is defined by two longitudinally contiguous foam panel sections (14A, 14A'). In the embodiment of FIGS. 5 and 6, the panel sections (14A, 14A') form a right angle, and in the embodiment of FIG. 7, they form a 45 degree angle. Of course, any other appropriate angular opening between the two panel sections (14A, 14A') may be considered within the scope of the present invention.

In order to strengthen and reinforce the corner wall, a connector (16) is positioned inside the corner as shown. The connector (16) includes a pair of anchor members (20A, 20B) each embedded longitudinally into one of the foam panel sections (14A, 14A'). A connecting member (32) longitudinally connects the two anchor members (20A, 20B) together. The anchor members (20A and 20B) and the connecting member (32) may be of the same design as the connector (16) described above, or, alternatively, connectors of a different construction may be used.

In a preferred embodiment, the connecting member (32) is preferably hingedly connected on each side to the corresponding anchor member (20A or 20B) through the use of open slotted tube-like knuckles (360), as described above. This embodiment is advantageous in that it allows the connecting member (32) to be easily removed to put the wall form in its collapsed position, and connected back on at the construction site. Other types of connections, hinged or otherwise, may also be used. The connecting member (32) may be removable from the anchor members (20A, 20B) or rigidly affixed thereto.

It should be noted on this point that advantageously, a corner wall form may have connectors with removable connecting members only on one side of the corner, as in FIGS. 5 and 7, all the connectors on the other side having for example hinged connecting elements as shown in FIGS. 2 and 3. This particular embodiment still allows the corner wall form to be put in a collapsed position for shipping, while limiting the number of open slotted tube-like knuckles, which are more expensive to manufacture.

Although preferred embodiments of the invention have been described in detail herein and illustrated in the accompanying drawings, it is to be understood that the invention is not limited to these precise embodiments and that various changes and modifications may be effected therein without departing from the scope or spirit of the invention as defined in the appended claims.

What is claimed is:

1. A wall form for receiving a flowable material, comprising:

a pair of foam panels each having opposed top and bottom wall surfaces; and a connector for tying together said foam panels in spaced and parallel relationship along a longitudinal direction, said connector comprising a pair of elongated anchor members each embedded longitudinally inside a corresponding one of said foam panels, each of said anchor members having two opposed extremities and a head piece projecting from each of said extremities along the longitudinal direction, the head pieces each having a terminal surface extending transversally and along a portion of a corresponding one of the top and bottom wall surfaces of the corresponding foam panel, the connector further comprising a connecting member for connecting longitudinally the anchor members of the pair together;

wherein each of the top and bottom wall surfaces of each of the foam panels is provided with alternating projections and recesses, the head pieces each being embedded into one of said projections.

2. A wall form according to claim 1, wherein each head piece is shaped so that its terminal surface is adapted to extend along either one of the top or bottom wall surfaces.

3. A wall form according to claim 1, wherein the head pieces of each anchor member are in mirror symmetry to each other.

4. A wall form according to claim 1, wherein, for each foam panel, each projection of the top wall surface is opposed to a recess of the bottom wall surface and each recess of the top wall is opposed to a projection of the bottom wall.

5. A wall form according to claim 1, wherein each head piece has an L-shaped portion having a transversal arm defining said terminal surface and a longitudinal arm connecting the transversal arm to the extremity of the anchor member from which said head piece is projecting.

6. A wall form assembly, comprising a plurality of wall forms according to claim 4, said wall forms being vertically stacked up.

7. A wall form assembly according to claim 6, wherein, for adjacent upper and lower wall forms, the terminal surfaces extending along the bottom wall surfaces of the foam panels of the upper wall form abut on the terminal surfaces extending along the top wall surfaces of the foam panels of the lower wall form.

8. A wall form for receiving a flowable material, comprising:

a pair of opposed foam panels in spaced and parallel relationship along a longitudinal direction, the pair of foam panels having aligned side end portions, each of said foam panels being provided with a longitudinal ridge extending therein along an inward surface thereof, said inward surface facing the opposed foam panel;

an end panel; and a mounting device comprising first and second engaging members removably engaging the respective side end portions of the pair of foam panels and mounting means for longitudinally mounting the end panel between the first and second engaging members.

9. A wall form according to claim 8, wherein each engaging member comprises a channel engageable with said ridge of a corresponding foam panel.

10. A wall form according to claim 9, wherein the first and second engaging members each define a sleeve for enfolding the side end portion of a corresponding foam panel.

11. A wall form according to claim 8, wherein the first and second engaging members are each made of a resilient material.

12. A wall form according to claim 11, wherein said resilient material is a plastic.

13. A wall form according to claim 8, wherein the mounting means comprise first and second panel supporting portions respectively projecting from the first and second engaging members.

14. A wall form according to claim 13, further comprising fastening means for fastening the end panel to the first and second panel supporting portions.

15. A wall form according to claim 13, wherein each of the first and second panel supporting portions defines a track for slidably receiving the end panel.

16. A wall form according to claim 8, wherein said end panel is made of wood.

17. In a wall form for receiving a flowable material, said wall form having a corner formed by a pair of longitudinally contiguous foam panel sections angled with respect to each other, the improvement wherein said wall form comprises a reinforcing connector for reinforcing said corner, comprising:

a pair of elongated anchor members, each being embedded longitudinally inside a corresponding one of said pair of foam panel sections; and a connecting member extending inside of said wall form and spanning said corner from the anchor member of one of said pair of foam panel members to the anchor member of the other of said pair of foam panel members;

wherein said connecting member is removably connected to the pair of anchor members.

18. The improved wall form according to claim 17, wherein each anchor member comprises:

an elongated flange plate extending longitudinally and deep inside the corresponding foam panel section; and an elongated link element connected longitudinally to the flange plate and having a projecting end coming out of the foam panel, said projecting end being connected to the connecting member.

19. The improved wall form according to claim 18, wherein:

the projecting end of each anchor member comprises a plurality of aligned open slotted tube-like knuckles, each tube-like knuckle forming an inner tube having a pair of longitudinal opposed edge portions defining a slot in registry with the slots of the other knuckles; and the connecting member has a pair of longitudinal side end each defining an enlarged end portion sized to be slidably insertable in said open tube-like knuckles and a strip portion connecting the enlarged end portion to a central portion of the connecting member.

* * * * *